US010815702B2

(12) United States Patent
Yoshino

(10) Patent No.: US 10,815,702 B2
(45) Date of Patent: Oct. 27, 2020

(54) OUTSIDE HANDLE DEVICE FOR VEHICLE

(71) Applicant: AISIN SEIKI KABUSHIKI KAISHA, Kariya-shi, Aichi-ken (JP)

(72) Inventor: Masaki Yoshino, Aichi-ken (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 518 days.

(21) Appl. No.: 15/262,844

(22) Filed: Sep. 12, 2016

(65) Prior Publication Data

US 2017/0089102 A1 Mar. 30, 2017

(30) Foreign Application Priority Data

Sep. 28, 2015 (JP) ..... 2015-189481

(51) Int. Cl.
*E05B 77/32* (2014.01)
*E05B 79/22* (2014.01)
(Continued)

(52) U.S. Cl.
CPC ..... *E05B 77/32* (2013.01); *E05B 79/22* (2013.01); *E05B 81/06* (2013.01); *E05B 81/76* (2013.01);
(Continued)

(58) Field of Classification Search
CPC ..... E05B 77/32; E05B 85/16; E05B 85/103; E05B 85/107; E05B 81/06; E05B 79/22; E05B 81/76
See application file for complete search history.

(56) References Cited

U.S. PATENT DOCUMENTS 7,621,573 B2 * 11/2009 Thomas ..... E05B 81/76 292/336.3
8,408,611 B2 * 4/2013 Takagai ..... E05B 77/04 292/336.3
(Continued)

FOREIGN PATENT DOCUMENTS

DE 102006048371 A1 4/2008
JP S60-138189 A 7/1985
(Continued)

OTHER PUBLICATIONS

The extended European Search Report dated Jan. 23, 2017, by the European Patent Office in corresponding European Patent Application No. 16190971.8-1609. (6 pgs).
(Continued)

*Primary Examiner* — Kristina R Fulton
*Assistant Examiner* — Thomas L Neubauer
(74) *Attorney, Agent, or Firm* — Buchanan Ingersoll & Rooney PC

(57) ABSTRACT

An outside handle device for a vehicle includes an outside handle being rotatably supported at a vehicle door between an initial position and an operation position, the operation position in which a lock device being provided at the vehicle door is switched from a latched state to an unlatched state, a first actuator generating a drive force that rotates the outside handle to a grip position that corresponds to a position between the initial position and the operation position, a first switch being disposed at a portion of the outside handle, the portion disposed inwardly of the vehicle, the first switch operating the first actuator when being pressed, and a switch operation lever rotating when the outside handle rotates inwardly of the vehicle from the initial position and pressing the first switch.

11 Claims, 7 Drawing Sheets

(51) Int. Cl.

| | |
|---|---|
| ***E05B 81/06*** | (2014.01) |
| ***E05B 85/16*** | (2014.01) |
| ***E05B 85/10*** | (2014.01) |
| ***E05B 81/76*** | (2014.01) |

(52) U.S. Cl.
CPC ..... *E05B 85/103* (2013.01); *E05B 85/107* (2013.01); *E05B 85/16* (2013.01)

(56) References Cited

U.S. PATENT DOCUMENTS

| | | | | |
|---|---|---|---|---|
| 2009/0039671 | A1* | 2/2009 | Thomas | E05B 81/76<br>296/146.1 |
| 2014/0132012 | A1* | 5/2014 | Yoshino | E05B 85/103<br>292/336.3 |

FOREIGN PATENT DOCUMENTS

| | | | | |
|---|---|---|---|---|
| JP | 2001-040913 | A | 2/2001 | |
| JP | 2009/0036971 | * | 2/2001 | B60J 5/04 |
| JP | 2001040913 | * | 4/2001 | |
| JP | 2004-244991 | A | 9/2004 | |
| JP | 2014-095251 | A | 5/2014 | |

OTHER PUBLICATIONS

Office Action (Notice of Reasons for Refusal) dated May 8, 2019, by the Japanese Patent Office in corresponding Japanese Patent Application No. 2015-189481, and an English Translation of the Office Action. (7 pages).

* cited by examiner

OUTSIDE HANDLE DEVICE FOR VEHICLE

CROSS REFERENCE TO RELATED APPLICATIONS

This application is based on and claims priority under 35 U.S.C. § 119 to Japanese Patent Application 2015-189481, filed on Sep. 28, 2015, the entire content of which is incorporated herein by reference.

TECHNICAL FIELD

This disclosure generally relates to an outside handle device for a vehicle.

BACKGROUND DISCUSSION

A known outside handle device being provided with an outside handle rotatably supported at a vehicle-exterior-side surface of an outer panel of a vehicle door is disclosed in JP2014-95251A (hereinafter referred to as Patent reference 1). The outside handle device is rotatable between an initial position and an operation position that is defined at an outside of the vehicle relative to the initial position.

The vehicle door disposed in Patent reference 1 includes a known lock device. The lock device is switchable between a latched state where the lock device retains the vehicle door in a closed state relative to a vehicle body, and an unlatched state where the lock device allows the vehicle door to rotate relative to the vehicle body. The outside handle and the lock device are operatively connected with each other via a power transmission mechanism. When the outside handle is disposed at the initial position, the lock device is latched. When the outside handle is disposed at the operation position, the lock device is unlatched.

When the outside handle disclosed in Patent reference 1 is disposed at the initial position, a vehicle-exterior-side surface of the outside handle and the vehicle-exterior-side surface of the outer panel are flush with each other. In other words, the vehicle-exterior-side surface of the outside handle and the vehicle-exterior-side surface of the outer panel are continuously provided. Accordingly, comparing to a case where the outside handle being disposed at the initial position is protrudingly provided from the outer panel to the outside of the vehicle, the designability of the vehicle door is enhanced, and an air resistance of the vehicle door when the vehicle is running may be reduced.

However, because the vehicle-exterior-side surface of the outside handle and the vehicle-exterior-side surface of the outer panel are flush with each other when the outside handle is disposed at the initial position, an occupant who is positioned at the outside of the vehicle cannot grip the outside handle that is disposed at the initial position and cannot rotate the outside handle to the operation position.

Accordingly, the outside handle device disclosed in Patent reference 1 includes a capacitive sensor and an actuator. The capacitive sensor is provided at the vehicle-exterior-side surface of the outside handle. The actuator is connected to the power transmission mechanism. The capacitive sensor and the actuator are connected to a control device.

When the occupant who is positioned at the outside of the vehicle touches the capacitive sensor of the outside handle being positioned at the initial position, signals are sent from the capacitive sensor to the control device. Accordingly, the control device operates the actuator. The power transmission mechanism receiving a drive force of the actuator rotates the outside handle being positioned at the initial position to a grip position that corresponds to an intermediate position between the initial position and the operation position.

When the outside handle rotates to the grip position, the occupant may grip the outside handle. Accordingly, the occupant may rotate the outside handle to the operation position while gripping the outside handle that is disposed at the grip position.

However, the capacitive sensor provided at the outside handle may be reacted even in a case where the occupant touches a position close to the outside handle of the vehicle-exterior-side surface of the outer panel. Accordingly, the outside handle may move from the initial position to the grip position against the occupant' will.

To solve this problem, for example, a mechanical switch may be provided at the vehicle-exterior-side surface of the outside handle. When the mechanical switch is pressed, the control device may operate the actuator.

However, in a case where the mechanical switch is mounted on the vehicle-exterior-side surface of the outside handle, the designability of the outside handle may be impaired, and the wiring of a harness for connecting the control device to the mechanical switch is difficult.

A need thus exists for an outside handle device for a vehicle which is not susceptible to the drawback mentioned above.

SUMMARY

According to an aspect of this disclosure, an outside handle device for a vehicle includes an outside handle being rotatably supported at a vehicle door between an initial position and an operation position, the operation position being defined at a vehicle outer position relative to the initial position, the operation position in which a lock device being provided at the vehicle door is switched from a latched state to an unlatched state, a first actuator generating a drive force that rotates the outside handle to a grip position that corresponds to a position between the initial position and the operation position, a first switch being disposed at a portion of the outside handle, the portion disposed inwardly of the vehicle, the first switch operating the first actuator when being pressed, and a switch operation lever rotating when the outside handle rotates inwardly of the vehicle from the initial position and pressing the first switch.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1A:
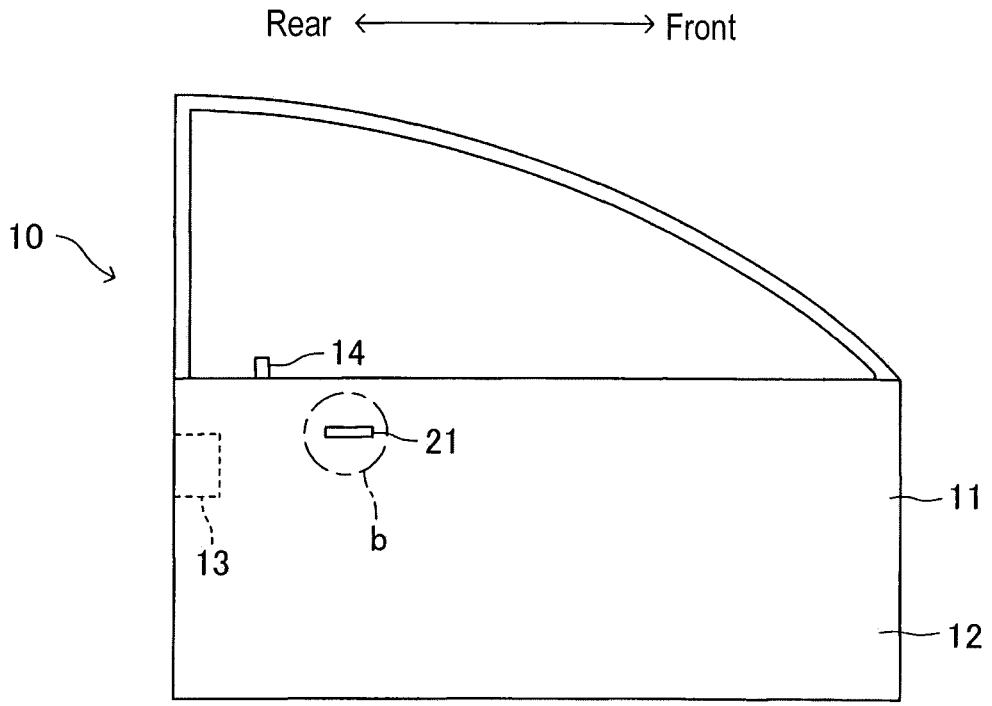
FIG. 1A is a side view schematically illustrating a vehicle door having an outside handle device when viewed from an outside of a vehicle disclosed here.
Figure 1B:
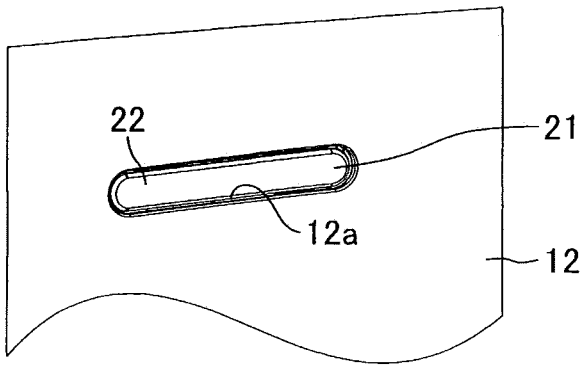
FIG. 1B is an enlarged perspective view of a b portion of FIG. 1A.

Hereinafter, an embodiment of this disclosure will be explained with reference to the drawings. A vehicle door 10 shown in FIGS. 1A and 1B is rotatably supported about a rotary axis in upper-lower directions relative to a vehicle body. The vehicle door 10 opens and closes an opening portion being provided at a side surface of the vehicle body. A vehicle-exterior-side surface of a door body portion 11 serving as a lower half of the vehicle door 10 is provided with an outer panel 12. A lock device 13 that includes a part being exposed at a rear end surface of the vehicle door 10 is provided at an inside of the vehicle door 10. The lock device 13 is provided with a known structure including a latch and a pawl. The lock device 13 is operatively connected to a lock knob 14 that is slidably provided at an upper end surface of a trim in the upper-lower directions, the trim serving as a vehicle-interior-side surface of the vehicle door 10. The lock device 13 is operatively connected to the outside handle device 20 that includes an outside handle 21 being rotatably supported at the outer panel 12.

As it is known, when the lock knob 14 is disposed at a lock position in a case where the vehicle door 10 closes the opening portion of the vehicle body, the lock device 13 comes to be in a latched state where the latch holds a striker fixed to the vehicle body. In this case, the lock device 13 maintains in the latched state even through the outside handle 21 rotates from the initial position (a position shown in FIGS. 1, 3 to 6 and a solid line in FIG. 2). On the other hand, when the outside handle 21 rotates from the initial position to the outside of the vehicle and moves to the operation position (a position of a two dot-chain line in FIG. 2 and FIG. 11) in a case where the lock knob 14 is disposed at an unlock position (a position in FIGS. 1A and 1B), the lock device 13 comes to be in an unlatched state where the latch releases the striker. Accordingly, the vehicle door 10 may rotate in an opening direction relative to the vehicle body.

Next, a structure of the outside handle device 20 will be explained in detail. The outside handle device 20 includes the outside handle 21, a support case 28, a motor 37 (i.e., serving as a first actuator and a second actuator), a rotary member 38, an unlock lever 40, a switch operation lever 48, an initial position detection switch S1, a first motor trigger switch S2 (i.e., serving as a first switch), a grip position detection switch S3, and a second motor trigger switch S4 (i.e., serving as a second switch).

Figure 9:
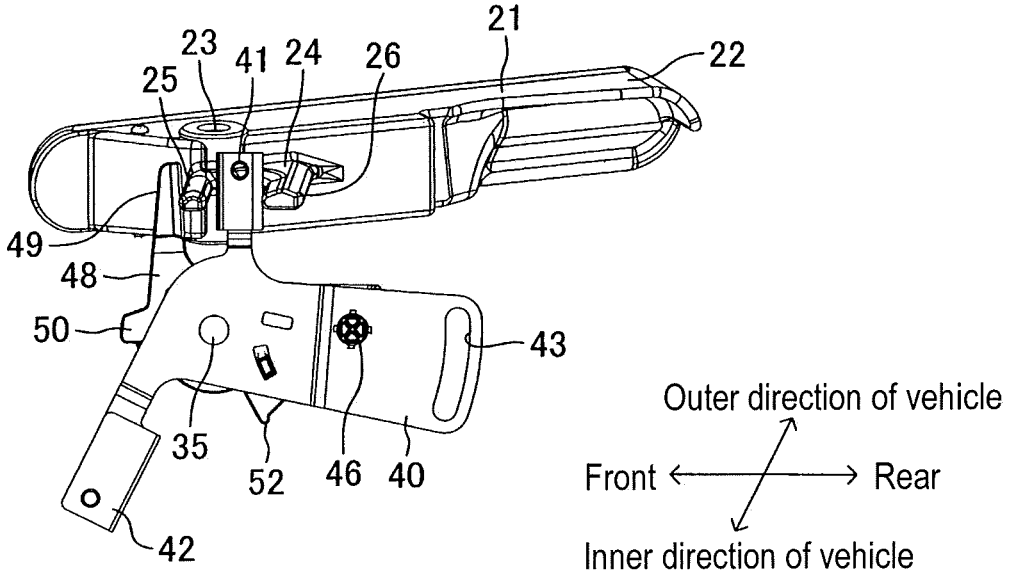
FIG. 9 is a perspective view of the outside handle, the switch operation lever and the unlock lever when the outside handle is disposed at the grip position when viewed from the inside of the vehicle.
Figure 10:
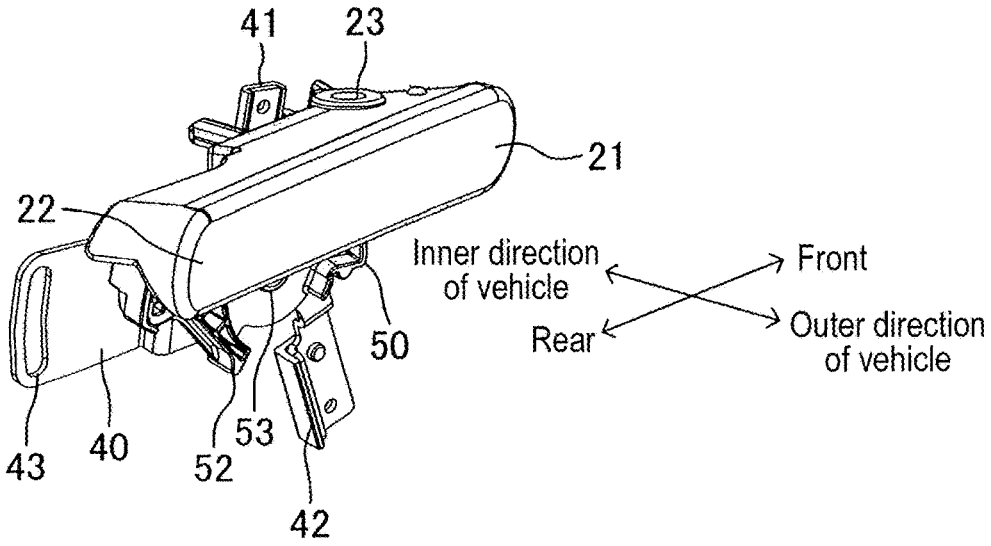
FIG. 10 is a perspective view of the outside handle, the switch operation lever and the unlock lever when the outside handle is disposed at the grip position when viewed from the outside of the vehicle.

The outside handle 21 is an elongated member extending in front-rear directions. Each of a front end and a rear end 22 of the outside handle 21 is formed in a substantially semicircle shape. A position close to the front end portion of the outside handle 21 includes a rotary center hole 23 (see FIG. 5) that is penetratingly provided at the outside handle 21 in the upper-lower directions. An engagement protrusion 24 protruding towards the inside of the vehicle is provided at a front portion of the vehicle-interior-side surface of the outside handle 21. As shown in FIG. 9, the engagement protrusion 24 is formed in a Y-shape including a pressing piece 25 and a stopper piece 26.

The support case 28 includes a body portion 29. A shape of a side surface of the body portion 29 is similar to a side surface of the outside handle 21. Because the whole of the vehicle-exterior-side surface of the body portion 29 is open, the outside handle 21 may be contained in an inner space of the body portion 29. A side surface portion 30 serving as the vehicle-interior-surface of the body portion 29 is provided with a through hole 31 extending in the front-rear directions. A plate-shaped stopper wall 29*a* being provided next to a rear end portion of the through hole 31 and extending in the upper-lower directions is protrudingly provided from the vehicle-interior-side surface of the side surface portion 30 toward the inside of the vehicle. Three mounting pieces 32 are protrudingly provided from an outer peripheral surface of the body portion 29. A plate-shaped support portion 33 extends downwardly from a lower end portion of the body portion 29. An outer peripheral wall 34 extending along an outer peripheral rim portion of the vehicle-interior-side surface of the support portion 33 is protrudingly provided at the outer peripheral rim portion toward the inside of the vehicle. A part of the outer peripheral wall 34 serves as a stopper wall 34*a* extending in the upper-lower directions. A first rotary shaft 35 is fixed to the vehicle-interior-side surface of the support portion 33. The first rotary shaft 35 is a cylindrical member extending to the inside of the vehicle.

The outside handle 21 is disposed within the inner space of the body portion 29 of the support case 28. A rotary shaft being fixed between a top surface and a bottom surface of the body portion 29 is provided within the rotary center hole 23 of the outside handle 21 in the upper-lower directions. Accordingly, the outside handle 21 is relatively rotatable about the rotary center hole 23 (rotary axis) in a horizontal direction relative to the support case 28. Specifically, the outside handle 21 is rotatable between the initial position and the operation position relative to the support case 28. In addition, the outside handle 21 is rotatable from the initial position to the inside of the vehicle. In particular, the outside handle 21 is rotatable to a motor operation position shown with a two dot-chain line in FIG. 2. Furthermore, a spring rotationally biasing the outside handle 21 to the operation position is provided between the rotary shaft of the body portion 29 and the outside handle 21. The engagement protrusion 24 of the outside handle 21 is protrudingly provided to the inside of the vehicle of the support case 28 via the through hole 31.

Figure 2:
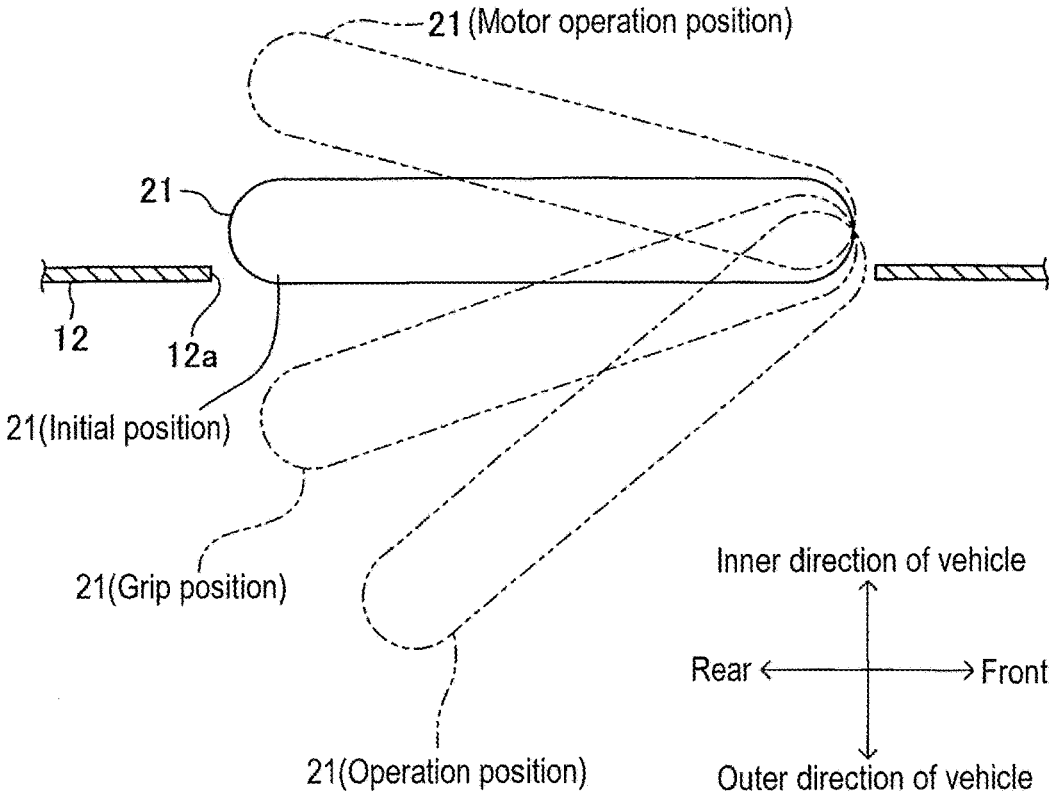
FIG. 2 is a plan view schematically illustrating a positional relationship between an outside handle and an outer panel.

As shown in FIG. 1B, a handle mounting hole 12*a* that has a similar shape of the outside handle 21 is provided at the outer panel 12 as a through hole. A fixing member is fixed to the vehicle-interior-side surface of the outer panel 12, and each of the mounting pieces 32 of the support case 28 is fixed to the fixing member with a screw. Because the support case 28 is fixed to the fixing member, as shown in FIGS. 1A and 1B, the outside handle 21 is disposed within the handle mounting hole 12*a*. When the outside handle 21 is disposed at the initial position, as shown in FIGS. 1A, 1B, and 2, the vehicle-exterior-side surface of the outside handle 21 is flush with the vehicle-exterior-side surface of the outer panel 12. In other words, the vehicle-exterior-side surface of the outside handle 21 and the vehicle-exterior-side surface of the outer panel 12 are continuously provided. When the outside handle 21 rotates from the initial position to the operation position, because (a part of) the outside handle 21 is protrudingly provided from the vehicle-exterior-side surface of the outer panel 12 to the outside of the vehicle, a gap is disposed between the vehicle-exterior-side surface of the outer panel 12 and the outside handle 21 (see FIG. 2).

As shown in FIGS. 3, 4, 8 and 11, the initial position detection switch S1, the first motor trigger switch S2, the grip position detection switch S3 and the second motor trigger switch S4 that correspond to mechanical switches are fixed to the vehicle-interior-side surface of the support portion 33 of the support case 28. The initial position detection switch S1, the first motor trigger switch S2, the grip position detection switch S3 and the second motor trigger switch S4 are connected to a control device.

The initial position detection switch S1, the first motor trigger switch S2, the grip position detection switch S3 and the second motor trigger switch S4 include switch pieces S1*a*, S2*a*, S3*a*, S4*a* (see FIGS. 7 and 12), respectively, that are retractable relative to body portions of the initial position detection switch S1, the first motor trigger switch S2, the grip position detection switch S3 and the second motor trigger switch S4, respectively. The initial position detection switch S1, the first motor trigger switch S2, the grip position detection switch S3 and the second motor trigger switch S4 further include plate springs S1*b*, S2*b*. S3*b*, S4*b* (see FIGS. 7 and 12), respectively, that are elastically deformed in directions where the plate springs S1*b*, S2*b*. S3*b*, S4*b* are in contact with the switch pieces S1*a*, S2*a*, S3*a*, S4*a*, respectively. The initial position detection switch S1, the first motor trigger switch S2, the grip position detection switch S3 and the second motor trigger switch S4 output detected signals to the control device when the plate springs S1*b*, S2*b*. S3*b*, S4*b* are applied with the pressing force and move the switch pieces S1*a*, S2*a*, S3*a*, S4*a* to insides of body portions of the switch pieces S1*a*, S2*a*, S3*a*, S4*a*, respectively. Because the pressing force applied to the plate springs S1*b*, S2*b*. S3*b*, S4*b* is ceased, the switch pieces S1*a*, S2*a*, S3*a*, S4*a* are returned to the initial position. Accordingly, the initial position detection switch S1, the first motor trigger switch S2, the grip position detection switch S3 and the second motor trigger switch S4 do not output the detected signals to the control device.

The electric motor 37 is fixed to the support portion 33. The motor 37 is connected to the control device. The motor 37 includes a rotary output shaft 37*a* that is in parallel with the first rotary shaft 35 and that is rotatable about an axis of the motor 37. The rotary member 38 is fixed to the rotary output shaft 37*a*. A cylindrical pin 39 (i.e., serving as a stopper) is in parallel with the first rotary shaft 35 and is fixed to the vehicle-interior-side surface of the rotary member 38. The rotary member 38 rotates between the initial position shown in FIGS. 3 and 4 and the operation position shown in FIGS. 8 and 11 in response to the rotation of the rotary output shaft 37*a*. The initial position of the rotary member 38 is defined at a position where the rotary member 38 comes in contact with the stopper portion 34*a* of the support portion 33.

Figure 3:
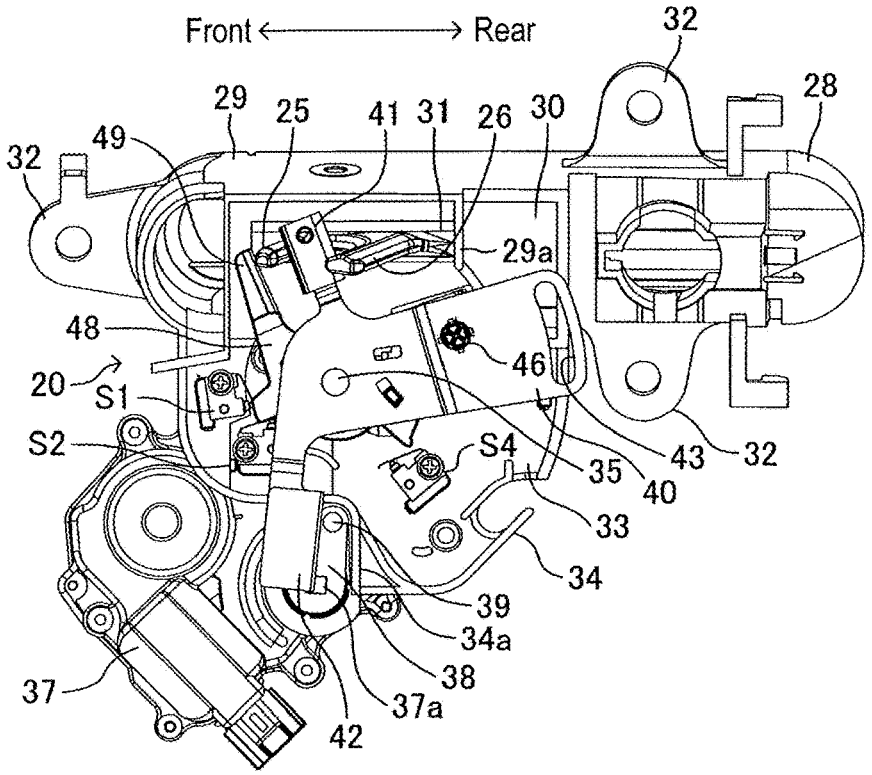
FIG. 3 is a perspective view of the outside handle device when the outside handle is disposed at an initial position when viewed from an inside of the vehicle.
Figure 8:
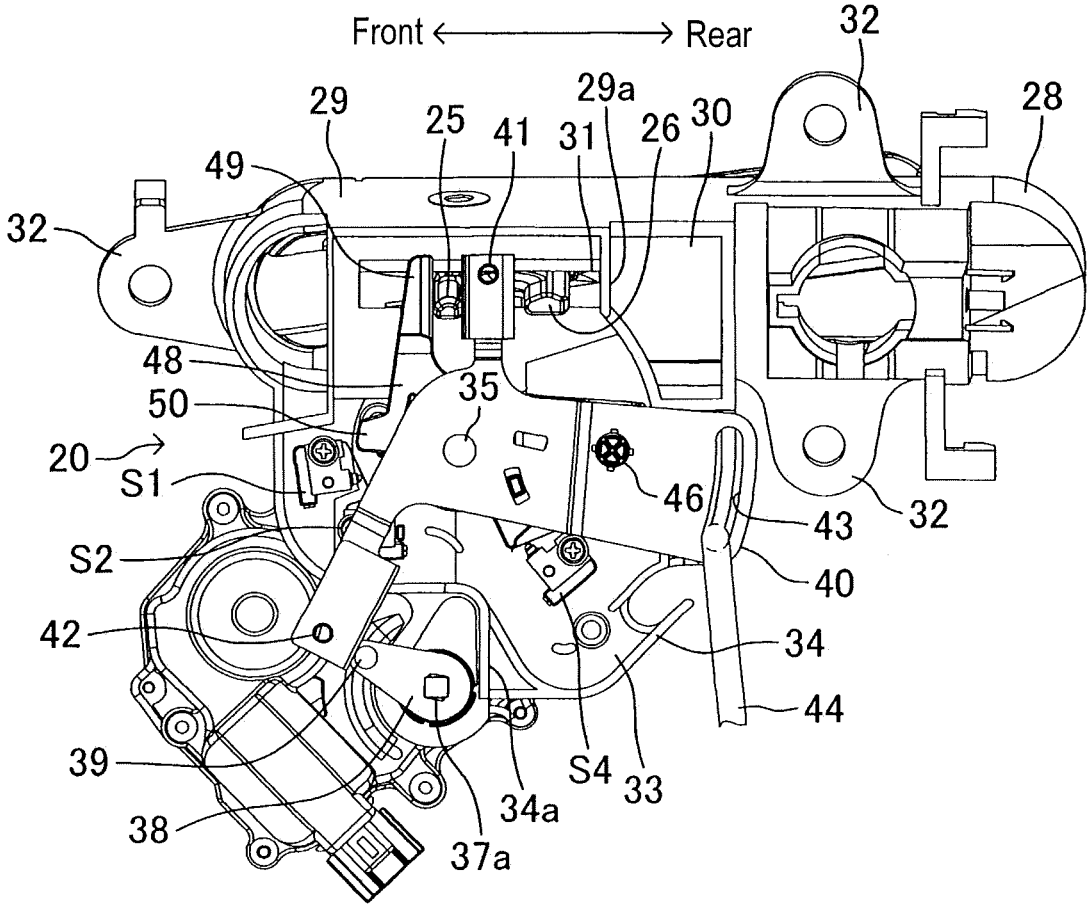
FIG. 8 is a perspective view of the outside handle device when the outside handle is disposed at a grip position when viewed from the inside of the vehicle.
Figure 11:
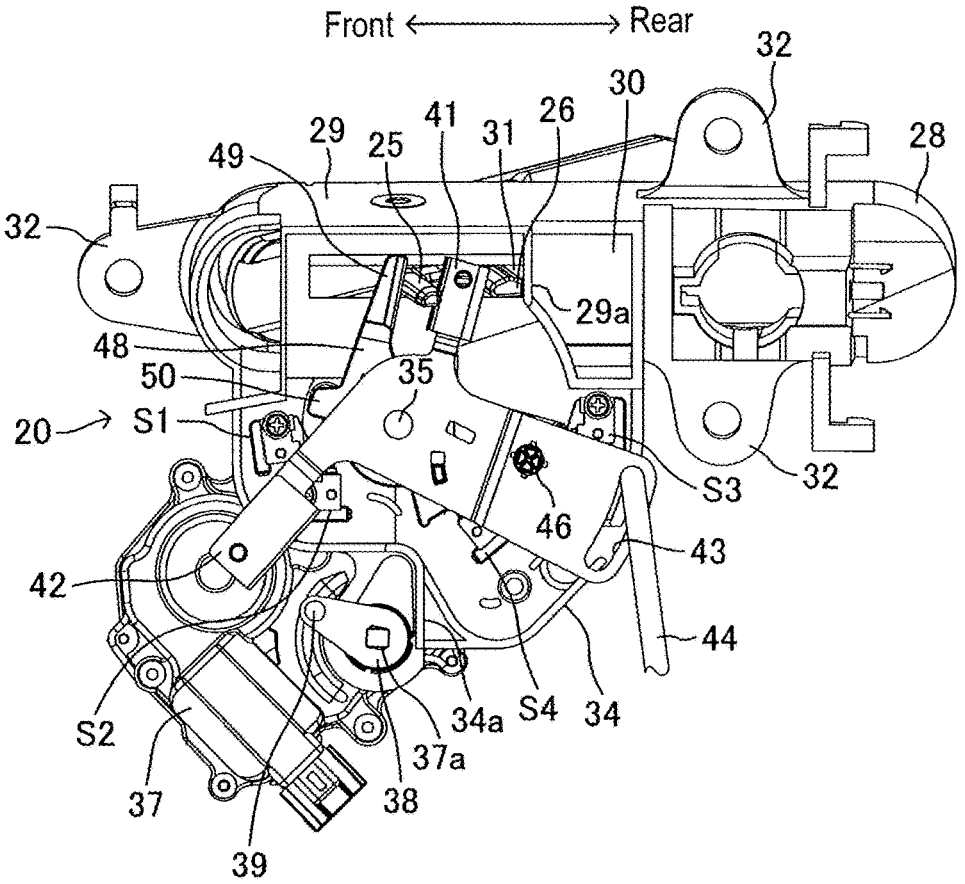
FIG. 11 is a perspective view of the outside handle device when the outside handle is disposed at an operation position when viewed from the inside of the vehicle.

The unlock lever 40 that is disposed at the inside of the vehicle of the support portion 33 is rotatably supported at the first rotary shaft 35. The unlock lever 40 includes a first protrusion 41 and a second protrusion 42. As shown in FIG. 3, the first protrusion 41 is disposed between the pressing piece 25 and the stopper piece 26 of the outside handle 21. The unlock lever 40 is provided with a rod connection hole 43 being formed in an arc shape about the first rotar shaft 35. A first end of a connection rod 44 shown in FIGS. 8 and 11 is slidably connected to the rod connection hole 43. A second end of the connection rod 44 is connected to the lock device 13.

A spring 45 (i.e., serving as a biasing member) is disposed between the first rotary shaft 35 and the unlock lever 40. The unlock lever 40 is continuously and rotationally biased in the anti-clockwise direction in FIGS. 3, 4, 5, 8, and 11 by a biasing force generated by the spring 45. Accordingly, when the unlock lever 40 rotates by the biasing force of the spring 45 in a case where the rotary member 38 is disposed at the initial position shown in FIGS. 3 and 4, the second protrusion 42 of the unlock lever 40 comes in contact with the pin 39 and restricts the unlock lever 40 from rotating at this position as shown in FIG. 3. The rotary position of the unlock lever 40 at this time corresponds to the initial position. When the unlock lever 40 is disposed at the initial position, the pressing piece 25 of the outside handle 21 that is rotationally biased to the operation position by a force smaller than the biasing force of the spring 45 comes in contact with the first protrusion 41 of the unlock lever 40 and position the outside handle 21 in the initial position. Here, a clearance is provided between the first protrusion 41 and the stopper piece 26. When the unlock lever 40 is disposed at the initial position, the first end of the connection rod 44 is connected to a lower end portion of the rod connection hole 43.

Figure 7:
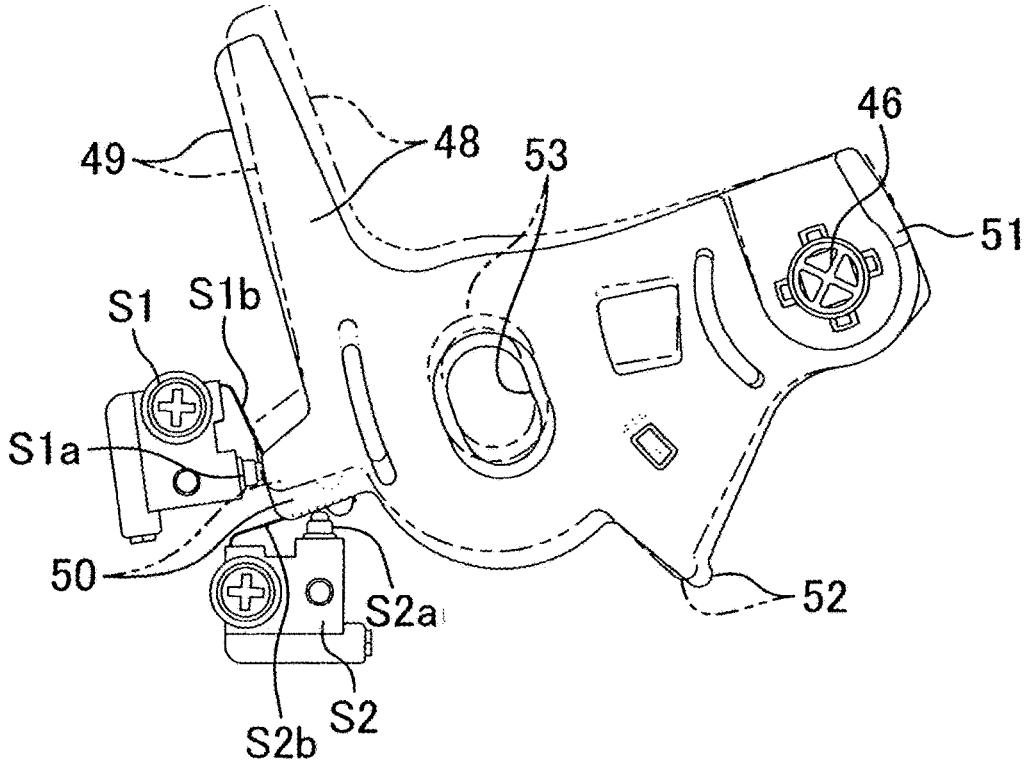
FIG. 7 is a side view of the switch operation lever, an initial position detection switch, and a first motor trigger switch when the outside handle rotates inwardly of the vehicle from the initial position when viewed from the inside of the vehicle.
Figure 12:
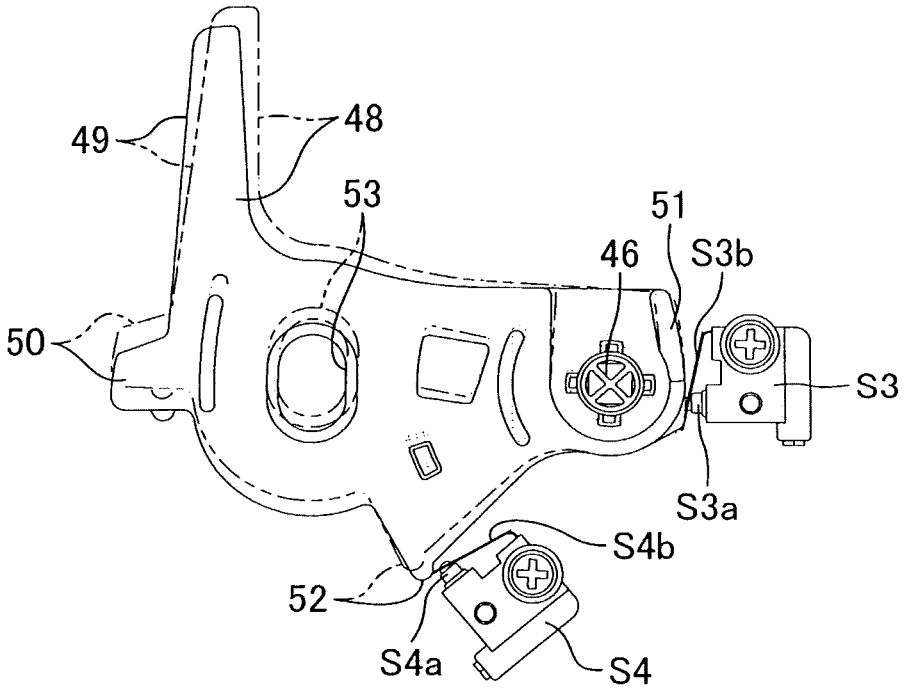
FIG. 12 is a side view of the switch operation lever, a grip position detection switch and a second motor trigger switch when the outside handle rotates from the grip position to the initial position when viewed from the inside of the vehicle.

The switch operation lever 48 is disposed between the vehicle-interior-side surface of the support portion 33 and the unlock lever 40. As shown in FIGS. 7 and 12, a pressed piece 49, a first pressing protrusion 50, a second pressing protrusion 51 and a third pressing protrusion 52 are protrudingly provided at an outer peripheral portion of the switch operation lever 48. A second rotary shaft 46 that is in parallel with the first rotary shaft 35 and that extends to the outside of the vehicle is fixed to the unlock lever 40. The switch operation lever 48 is rotatably supported to the second rotary shaft 46. Accordingly, the switch operation lever 48 is relatively rotatable about the second rotary shaft 46 relative to the unlock lever 40.

A center through hole 53 is provided at a center portion of the switch operation lever 48. The center through hole 53 is formed in an arc shape about the second rotary shaft 46. The first rotary shaft 35 is penetratingly disposed in the switch operation lever 48. The center through hole 53 includes a dimension in a longitudinal dimension, the dimension that is greater than a radius of the first rotary shaft 35. Accordingly, the switch operation lever 48 is relatively rotatable about the unlock lever 40 within a range where the first rotary shaft 35 does not come in contact with an end surface of the center through hole 53 in the longitudinal direction.

A spring continuously and rotationally biasing the switch operation lever 48 to the unlock lever 40 in the clockwise direction in FIGS. 3, 5, 7, and 12 is provided between the second rotary shaft 46 and the switch operation lever 48. The biasing force of the spring is smaller than the biasing force of the spring 45. The biasing force of the spring 45 is greater than the total of the biasing force of the spring and the biasing force of the spring that rotationally biases the outside handle 21. Accordingly, when the unlock lever 40 is disposed at the initial position and the outside handle 21 is disposed at the initial position, because the pressed piece 49 comes in contact with the pressing piece 25 in a front direction, the switch operation lever 48 is retained at a first position shown in FIGS. 3, 5, and 6.

Next, the operation of the outside handle device 20 will be explained. When the vehicle door 10 closes the opening portion of the vehicle body and when the lock device 13 in in a latched state, the outside handle device 20 is disposed as shown in FIGS. 3 to 6. That is, the outside handle 21 is disposed at the initial position. The rotary member 38 is disposed at the initial position. The unlock lever 40 is disposed at the initial position. The switch operation lever 48 is disposed at the first position.

The first, second, and third pressing protrusions 50, 51, 52 are disposed on the same plane, or on the same level as the initial position detection switch S1, the first motor trigger switch S2, the grip position detection switch S3 and the second motor trigger switch S4, respectively. Accordingly, the first pressing protrusion 50 comes in contact with, or comes to be away from the initial position detection switch S1 and the first motor trigger switch S2 in response to the rotation of the switch operation lever 48. Similarly, the second and third pressing protrusions 51, 52 come in contact with or come to be away from the grip position detection switch S3 and the second motor trigger switch S4 in response to the rotation of the switch operation lever 48. when the outside handle device 20 is disposed as shown in FIGS. 3 to 6, the first pressing protrusion 50 of the switch operation lever 48 that is disposed at the first position presses the plate spring S1*b* of the initial position detection switch S1 as shown in two dot-chain lines in FIGS. 2 and 7. Accordingly, the initial position detection switch S1 outputs detected signals to the control device. The first motor trigger switch S2, the grip position detection switch S3, and the second motor trigger switch S4 do not output detected signals because the first motor trigger switch S2, the grip position detection switch S3, and the second motor trigger switch S4 are not pressed by the switch operation lever 48. The control device that receives the detected signals from the initial position detection switch S1 recognizes that the outside handle 21 and the unlock lever 40 are disposed at the initial positions, respectively (that the outside handle 21 is contained in the handle mounting hole 12*a* of the outer panel 12 and in the body portion 29 of the support case 28).

When an occupant who is positioned at the outside of the vehicle that is provide with the vehicle door 10 presses the rear end portion 22 of the outside handle 21 to the inside of the vehicle (to an inside of the body portion 29), the outside handle 21 rotates to the motor operation position against the biasing force of the spring. Then, the vehicle-exterior-side surface of the outside handle 21 moves to the inside of the vehicle relative to the vehicle-exterior-side surface of the outer panel 12 (see FIG. 2). Furthermore, the pressing piece 25 of the outside handle 21 presses the pressed piece 49 of the switch operation lever 48 in the front direction. Accordingly, the switch operation lever 48 rotates about the second rotary shaft 46 in the anti-clockwise direction in FIGS. 3 and 5 relative to the support case 28 and the unlock lever 40. Because the unlock lever 40 is retained at the initial position by the spring 45 and the pin 39, the unlock lever 40 does not rotate about the first rotary shaft 35. As a result, the switch operation lever 48 being disposed at the first position rotates to a second position shown in a solid line in FIG. 7. As shown in FIG. 7, the first pressing protrusion 50 of the switch operation lever 48 presses the plate spring S2*b* of the first motor trigger switch S2 while pressing the plate spring S1*b* of the initial position detection switch 51. Accordingly, the initial position detection switch S1 continuously outputs the detected signals to the control device, and the first motor trigger switch S2 outputs the detected signals to the control device. Because the switch operation lever 48 does not press the grip position detection switch S3 and the second motor trigger switch S4, the grip position detection switch S3 and the second motor trigger switch S4 do not output the detected signals.

Figure 4:
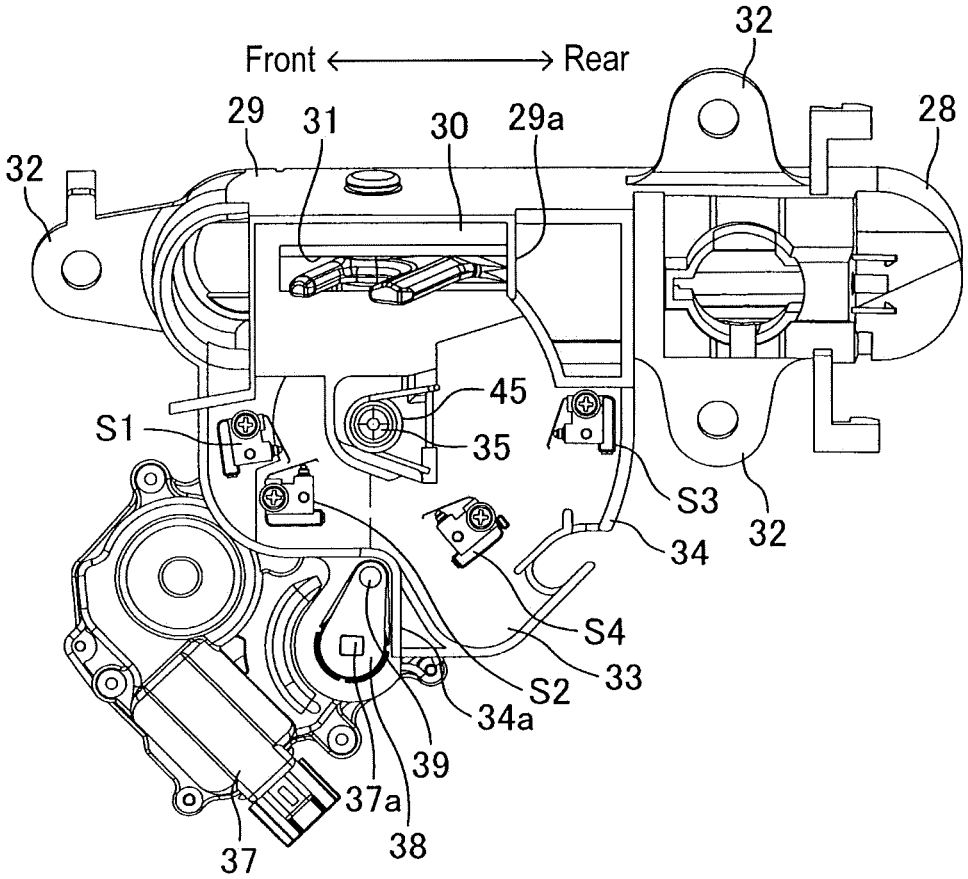
FIG. 4 is a perspective view of the outside handle device when the outside handle is disposed at the initial position in a case where a switch operation lever and an unlock lever are not illustrated.
Figure 5:
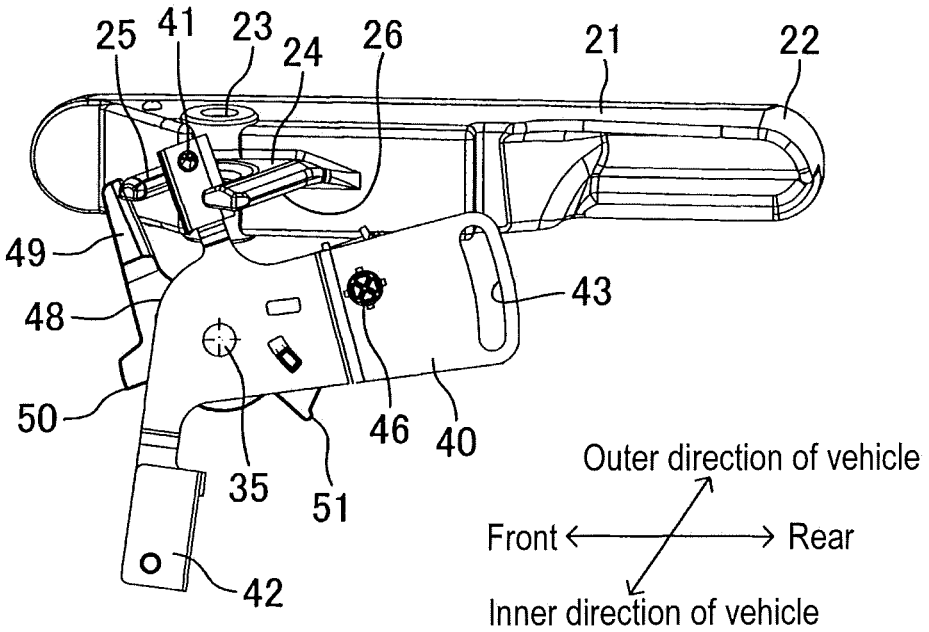
FIG. 5 is a perspective view of the outside handle, the switch operation lever and the unlock lever when the outside handle is disposed at the initial position when viewed from the inside of the vehicle.
Figure 6:
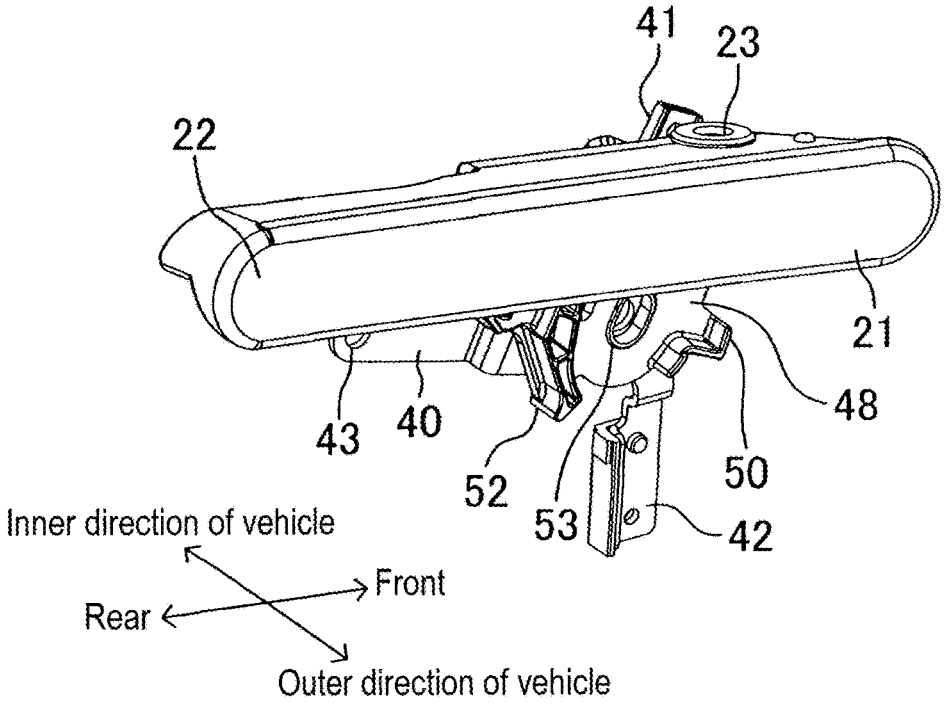
FIG. 6 is a perspective view of the outside handle, the switch operation lever and the unlock lever when the outside handle is disposed at the initial position when viewed from an outside of the vehicle.

Because the control device receiving the detected signals from the first motor trigger switch S2 transmits normal rotation signals to the motor 37, the motor 37 rotates the rotary output shaft 37*a* in the anti-clockwise direction shown in FIGS. 3 and 4. As a result, the rotary member 38 that is disposed at the initial position rotates to the operation position shown in FIG. 8. Because the pin 39 being fixed to the rotary member 38 presses the second protrusion 42, the unlock lever 40 rotates about the first rotary shaft 35 in the clockwise direction shown in FIG. 8, against the biasing force of the spring 45, and moves to the grip position shown in FIG. 8 when the rotary member 38 reaches the operation position. When the rotary member 38 reaches the operation position, the motor 37 stops the normal rotation. Even in a case where the unlock lever 40 moves from the initial position to the grip position, the unlock lever 40 cannot apply a force pressing the connection rod 44 downwardly to the connection rod 44. Accordingly, the lock device 13 is maintained in the latched state. The unlock lever 40 tries to rotate to the initial position by the biasing force of the spring 45 even after moving to the grip position. However, a straight line direction connecting the rotary output shaft 37*a* to the pin 39 is substantially orthogonal to a straight line direction connecting the first rotary shaft 35 to the second protrusion 42. Accordingly, the pin 39 fixed to the rotary member 38 that is disposed at the operation position securely prevents the unlock lever 40 from rotating to the initial position.

When the first protrusion 41 moves rearward in response to the unlock lever 40 that rotates from the initial position to the grip position, the pressing piece 25 of the outside handle 21 being rotationally biased to the operation position by the spring moves rearward to follow the first protrusion 41. Accordingly, the outside handle 21 rotates from the initial position to the grip position shown in the two dot-chain line in FIG. 2 and FIGS. 8 to 10.

When the unlock lever 40 rotates from the initial position to the grip position, the switch operation lever 48 that is supported by the second rotary shaft 46 being fixed to the unlock lever 40 rotates with the unlock lever 40 about the first rotary axis 35. When the unlock lever 40 reaches the grip position, the switch operation lever 48 reaches a third position shown in FIGS. 8 to 10, and a two dot-chain line in FIG. 12. Then, the first pressing protrusion 50 of the switch operation lever 48 comes to be away from the initial position detection switch S1 (the plate spring S1*b*) and the first motor trigger switch S2 (the plate spring S2*b*), and instead, the second pressing protrusion 51 of the switch operation lever 48 presses the plate spring S3*b* of the grip position detection switch S3 (see the two-dot-chain line in FIG. 12). Thus, the grip position detection switch S3 outputs the detected signals to the control device while the initial position detection switch S1 and the first motor trigger switch S2 stop outputting the detected signals to the control device. As a result, the control device recognizes that the outside handle 21 and the unlock lever 40 are disposed at the grip position. When the switch operation lever 48 rotates with the unlock lever 40 about the first rotary shaft 35 and moves from the second position to the third position, (the third pressing protrusion 52 of) the switch operation lever 48 passes the second motor trigger switch S4 (the switch operation lever 48 does not come in contact with the second motor trigger switch S4).

When the outside handle 21 rotates to the grip position, an occupant may grip the rear end portion 21 of the outside handle 21. Thus, the passenger rotates the outside handle 21 to the operation position while gripping the rear end portion 22 of the outside handle 21 being disposed at the grip position. The operation position corresponds to a position where the stopper piece 26 of the outside handle 21 comes in contact with the stopper wall 29*a* (see FIG. 11). When the passenger rotates the outside handle 21 from the grip position to the operation position by hand, as shown in FIG. 11, the pressing piece 25 of the outside handle 21 presses the first protrusion 41 rearward. Accordingly, the unlock lever 40 rotates about the first rotary shaft 35 in the clockwise direction of FIG. 11 against the biasing forge of the spring 45. When the outside handle 21 reaches the operation position, because the first protrusion 41 of the unlock lever 40 being rotationally biased in the anti-clockwise direction by the spring 45 comes in contact with the pressing piece 25, the unlock lever 40 is retained at the operation position shown in FIG. 11. When the unlock lever 40 moves to the operation position, the second protrusion 42 comes to be away from the second protrusion 42. Moreover, when the unlock lever 40 moves to the operation position, because the rod connection hole 43 of the unlock lever 40 moves downwardly from a position shown in FIG. 8 and an upper end portion of the rod connection hole 43 presses the first end of the connection rod 44 downwardly, the connection rod 44 presses downwardly and the lock device 13 being connected to the second end of the connection rod 44 comes to be unlatched.

When the unlock lever 40 rotates about the first rotary shaft 35 from the grip portion to the operation portion, the switch operation lever 48 being supported by the second rotary shaft 46 that is fixed to the unlock lever 40 rotates with the unlock lever 40 about the first rotary shaft 35. As a result, because the switch operation lever 48 moves from the third position, the second pressing protrusion 51 comes to be away from the grip position detection switch S3. Accordingly, the grip position detection switch S3 stops outputting the detected signals to the control device. Here as well, (the third pressing protrusion 52 of) the switch operation lever 48 passes the second motor trigger switch S4 (the switch operation lever 48 does not come in contact with the second motor trigger switch S4).

When an occupant releases a hand from the outside handle 21 in a state where the outside handle 21 is disposed at the operation position, the unlock lever 40 rotates about the first rotary shaft 35 in the anti-clockwise direction by the rotational biasing force of the spring 45, and rotates from the operation position to the grip position. Because the first protrusion 41 of the unlock lever 40 presses the pressing piece 25 of the outside handle 21 in the frontward direction, the outside handle 21 rotates to the grip position. Furthermore, the switch operation lever 48 that is supported by the second rotary shaft 46 being fixed to the unlock lever 40 rotates to the third position. Accordingly, the second pressing protrusion 51 presses the grip position detection switch S3 one more time.

When an occupant rotates the outside handle 21 that is disposed at the grip position to the initial position by hand (when an occupant presses the outside handle 21 to the inside of the vehicle), the pressing piece 25 of the outside handle 21 presses the pressed piece 49 of the switch operation lever 48 in the frontward direction. Accordingly, the switch operation lever 48 rotates in the anti-clockwise direction in FIGS. 3, 5, and 8 relative to the support case 28 and the unlock lever 40. Here, as shown in FIG. 8, because the unlock lever 40 is retained at the initial position by the spring 45 and the pin 39, the unlock lever 40 does not rotate about the first rotary shaft 35. That is, the switch operation lever 48 rotates about the second rotary shaft 46 instead of the first rotary shaft 35 from the third position toward the second position. When the switch operation lever 48 reaches a fourth position (a solid line in FIG. 12) that is disposed between the third position and the second position, the third pressing protrusion 52 presses the plate spring S4*b* of the second motor trigger switch S4 while the second pressing protrusion 51 presses the grip position detection switch S3. Accordingly, the grip position detection switch S3 continuously outputs the detected signals to the control device. The second motor trigger switch S4 outputs the detected signals to the control device. In this case as well, because the initial position detection switch S1 and the first motor trigger switch S2 are not pressed by the switch operation lever 48, the initial position detection switch S1 and the first motor trigger switch S2 do not output the detected signals.

Because the control device receiving the detected signals from the second motor trigger switch S4 transmits reverse signals to the motor 37, the motor 37 reversely rotates the rotary output shaft 37*a* in the clockwise direction in FIG. 8. As a result, the rotary member 38 being disposed at the operation position rotates to the initial position shown in FIG. 3. Accordingly, the unlock lever 40 being rotationally biased to the initial position by the spring 45 rotates to the initial position in FIG. 3 while making the second protrusion 42 come in contact with the pin 39. The outside handle 21 returns to the initial position in conjunction with the returning movement of the unlock lever 40 to the initial position, and the switch operation lever 48 returns to the first position. When the rotary member 38 reaches the initial position, the motor 37 stops the reverse movement.

As mentioned above, when the outside handle 21 rotates to the motor operation position that is defined at the inside of the vehicle from the initial position where the outside handle 21 is flush with vehicle-exterior-side surface of the outer panel 12, the switch operation lever 48 rotates while pressing the first motor trigger switch S2 that is disposed at the inside of the vehicle of the outside handle 21. Because the motor 37 rotates in the normal direction, the outside handle 21 rotates from the initial position to the grip position. Accordingly, the outside handle 21 disposed at the initial position may be moved to the grip position by the drive force of the motor 37 without having the first motor trigger switch S2 at the vehicle-exterior-side surface of the outside handle 21.

Because the motor trigger switch S2 is not provided at the vehicle-exterior-side surface of the outside handle 21, the designability of the outside handle 21 may not be decreased. Moreover, comparing to a case where the first motor trigger switch S2 is provided at the vehicle-exterior-side surface of the outside handle 21, for example, the wiring of a harness for connecting the control device to the first motor trigger switch S2 may be easily accomplished.

The outside handle 21 may not rotate from the initial position to the grip position by the power of the motor 37 as long as the outside handle 21 does not rotate from the initial position to the motor operation position. Accordingly, the outside handle 21 being disposed at the initial position rarely moves to the grip position by the power of the motor 37 against an occupant's will.

A rotary center of the switch operation lever 48 switches between the first rotary shaft 35 and the second rotary shaft 46 in a case where the outside handle 21 rotates from the motor operation position to the grip position by the drive force of the motor 37, and in a case where the outside handle 21 rotates from the grip position to the initial position. That is, a rotational trace of the switch operation lever 48 in a case where the outside handle 21 rotates from the motor operation position to the grip position by the drive force of the motor 37 is different from a case where the outside handle 21 rotates from the grip position to the initial position. When the outside handle 21 rotates from the grip position to the initial position, the unlock lever 40 is restricted from rotating without using the drive force of the motor 37. Accordingly, when the outside handle 21 rotates from the motor operation position to the grip position by the drive force of the motor 37, the switch operation lever 48 integrally rotates with the unlock lever 40 about the first rotary shaft 35 and passes the second motor trigger switch S4 (and does not come in contact with the second motor trigger switch S4). On the other hand, when the outside handle 21 rotates from the grip position to the initial position, the switch operation lever 48 being pressed by the outside handle 21 rotates about the second rotary shaft 46 to press the second motor trigger switch S4. Accordingly, when the outside handle 21 rotates from the grip position to the initial position, the outside handle 21 rotates to the initial position by the drive force of the motor 37 whereas when the outside handle 21 rotates from the motor operation position to the grip position by the drive force of the motor 37, the outside handle 21 does not return to the initial position by the drive force of the motor 37.

This disclosure is not limited to the aforementioned embodiment. For example, in a case where the motor 37 is out of order, the outside handle 21 rotates to the grip position by the pressing of the front end portion of the outside handle 21 that is disposed at the initial position to the inside of the vehicle. A first motor (a first actuator) for moving the rotary member 38 from the initial position to the operation position and a second motor (a second actuator) for moving the rotary member 38 from the operation position to the initial position may be separately provided. An actuator other than the electric motor may serve as an actuator supporting the motor 37 (the first and second actuators).

This disclosure is applicable to a sliding vehicle door.

This disclosure is applied to the vehicle door 10 in which the vehicle-exterior-side surface of the outside handle 21 disposed at the initial position is not flush with the vehicle-exterior-side surface of the outer panel 12.

According to the aforementioned embodiment, the outside handle device (20) for the vehicle includes the outside handle (21) being rotatably supported at the vehicle door (10) between the initial position and the operation position, the operation position being defined at the vehicle outer position relative to the initial position, the operation position in which the lock device (13) being provided at the vehicle door (10) is switched from the latched state to the unlatched state, the first actuator (the motor 37) generating the drive force that rotates the outside handle (21) to the grip position that corresponds to the position between the initial position and the operation position, the first switch (the first motor trigger switch S2) being disposed at the portion of the outside handle (21), the portion disposed inwardly of the vehicle, the first switch (the first motor trigger switch S2) operating the first actuator (the motor 37) when being pressed, the switch operation lever (48) rotating when the outside handle (21) rotates inwardly of the vehicle from the initial position and pressing the first switch (the first motor trigger switch S2).

According to the aforementioned construction, when the outside handle 21 rotates from the initial position to the inside of the vehicle, the switch operation lever 48 presses the first switch (the first motor trigger switch S2) disposed at the inside of the vehicle of the outside handle 21 and rotates. Because the first actuator (the electric motor 37), the outside handle 21 rotates from the initial position to the grip position by the drive force of the first actuator (the electric motor 37). Accordingly, the outside handle 21 disposed at the initial position may be moved to the grip position by the drive force of the first actuator (the motor 37) without having the first motor trigger switch S2 at the vehicle-exterior-side surface of the outside handle 21.

According to the aforementioned embodiment, the outside handle device (20) for the vehicle further includes the unlock lever (40) that is separately provided from the switch operation lever (48), the unlock lever (40) moving the lock device (13) to be unlatched when the outside handle (21) rotates to the operation position, and the unlock lever (40) allowing the lock device (13) to be latched when the outside handle (21) rotates inwardly of the vehicle from the initial position.

According to the aforementioned construction, the lock device 13 may be retained in the unlatched state when the outside handle 21 rotates from the initial position to the inside of the vehicle.

According to the aforementioned embodiment, the unlock lever (40) is rotatably supported at the vehicle door (10), and the switch operation lever (48) is rotatably supported at the unlock lever (40).

According to the aforementioned construction, the rotary support structure of the switch operation lever 48 and the unlock lever 40 may be easily provided.

According to the aforementioned embodiment, the outside handle device (20) for the vehicle further includes the second actuator (the motor 37) generating a drive force that rotates the outside handle (21) from the grip position to the initial position, the second switch (the second motor trigger switch S4) being separately provided from the first switch (the first motor trigger switch S2), the second switch (the second motor trigger switch S4) operating the second actuator (the motor 37) when being pressed by the switch operation lever (48), the first rotary shaft (35) rotatably supporting the unlock lever (40) relative to the vehicle door (10), the second rotary shaft (46) being separately provided from the first rotary shaft (35), the second rotary shaft (46) rotatably supporting the switch operation lever (48) relative to the unlock lever (40), the biasing member (the spring 45) rotating the unlock lever (40) in the specific direction about the first rotary shaft (35), and the stopper (the pin 39) restricting the unlock lever (40) from rotating in the specific direction to retain the unlock lever (40) at the specific position. When the outside handle (21) rotates to the grip position by the drive force of the first actuator (the motor 37), the switch operation lever (48) integrally rotates with the unlock lever (40) about the first rotary shaft (35) while not coming in contact with the second switch (the second motor trigger switch S4). When the outside handle (21) rotates from the grip position to the initial position, the unlock lever (40) that rotates in the specific direction by the biasing force of the biasing member (the spring 45) comes in contact with the stopper (the pin 39), and the switch operation lever (48) being pressed by the outside handle (21) rotates about the second rotary shaft (46) while pressing the second switch (the second motor trigger switch S4).

The rotary center of the switch operation lever 48 switches between the first rotary shaft 35 and the second rotary shaft 46 in a case where the outside handle 21 rotates from the initial position to the grip position by the drive force of the first actuator (the motor 37), and in a case where the outside handle 21 rotates from the grip position to the initial position. That is, a rotational trace of the switch operation lever 48 in a case where the outside handle 21 rotates from the initial position to the grip position by the drive force of the motor 37 is different from a case where the outside handle 21 rotates from the grip position to the initial position. When the outside handle 21 rotates from the grip position to the initial position, the unlock lever 40 is restricted from rotating without using the drive force of the motor 37 because the unlock lever 40 rotating in the specific direction by the biasing force of the biasing member (the spring 45) comes in contact with the stopper (the cylindrical pin 39). Accordingly, when the outside handle 21 rotates from the initial position to the grip position by the drive force of the motor 37, the switch operation lever 48 integrally rotates with the unlock lever 40 about the first rotary shaft 35 and passes the second motor trigger switch S4 (and does not come in contact with the second motor trigger switch S4). On the other hand, when the outside handle 21 rotates from the grip position to the initial position, the switch operation lever 48 being pressed by the outside handle 21 rotates about the second rotary shaft 46 to press the second switch (the second motor trigger switch S4). Accordingly, when the outside handle 21 rotates from the grip position to the initial position, the outside handle 21 rotates to the initial position by the drive force of the second actuator (the motor 37) whereas when the outside handle 21 rotates from the initial position to the grip position by the first actuator (the drive force of the motor 37), the outside handle 21 may be prevented from returning to the initial position by the drive force of the second actuator (the motor 37).

According to the aforementioned embodiment, the outside handle device (20) for the vehicle further includes the rotary member (38) moving the outside handle (21) from the initial position to the grip position by rotating by the drive force of the first actuator (the motor 37) when the first switch (the first motor trigger switch S2) is pressed by the switch operation lever (48), and the rotary member (38) restricting the outside handle (21) from rotating to the initial position by coming in contact with the unlock lever (40) that is operatively connected with the outside handle (21) when the outside handle (21) is disposed at the grip position.

According to the aforementioned construction, the rotary member 38 restricts the outside handle 21 from moving to the grip position, and from rotating the outside handle from the grip position to the initial position. Accordingly, comparing to a case where one member has a feature that moves the outside handle 21 to the grip position while the other member has a feature that restricts the outside handle 21 from moving to the initial position, the outside handle device for the vehicle may be easily constructed.

According to the aforementioned embodiment, the outside handle (21) includes the vehicle-exterior-side surface, and the vehicle door (10) includes a vehicle-exterior-side surface. When the outside handle (21) is disposed at the initial position, the vehicle-exterior-side surface of the outside handle (21) is flush with the vehicle-exterior-side surface of the vehicle door (10).

According to the aforementioned construction, comparing to a case where the outside handle disposed at the initial position protrudes from the vehicle-exterior-side surface of the vehicle door 10 to the outside of the vehicle, the designability of the vehicle door 10 may be enhanced and the air resistance of the vehicle door 10 when the vehicle is running may be reduced.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An outside handle device for a vehicle, comprising:

a lock device provided at a vehicle door;

an outside handle rotatably supported at the vehicle door between an initial position and an operation position, the operation position being defined at a vehicle outer position relative to the initial position, the operation position in which the lock device is switched from a latched state to an unlatched state;

a first switch disposed at a portion of the outside handle, the portion disposed inwardly of the vehicle;

a second switch separately provided from the first switch;

a switch operation lever configured to operate the first switch and the second switch;

a first actuator configured to be operated by the first switch to generate a drive force that rotates the outside handle to a grip position that corresponds to a position between the initial position and the operation position when the switch operation lever rotates in response to rotation of the outside handle inwardly of the vehicle from the initial position and causes the switch operation lever to rotate and cause the first switch to operate the first actuator;

a second actuator configured to be operated by the second switch to generate a drive force that rotates the outside handle from the grip position to the initial position when the second switch is pressed by the switch operation lever; and an unlock lever that is separately provided from the switch operation lever, the outside handle causing the unlock lever to move the lock device to be unlatched when the outside handle rotates to the operation position, and the unlock lever allowing the lock device to be latched when the outside handle rotates inwardly of the vehicle from the initial position.

2. The outside handle device for the vehicle according to claim 1, wherein the unlock lever is rotatably supported at the vehicle door, and the switch operation lever is rotatably supported at the unlock lever.

3. The outside handle device for the vehicle according to claim 2, further comprising:

a first rotary shaft rotatably supporting the unlock lever relative to the vehicle door;

a second rotary shaft being separately provided from the first rotary shaft, the second rotary shaft rotatably supporting the switch operation lever relative to the unlock lever;

a biasing member configured to rotate the unlock lever in a specific direction about the first rotary shaft; and a stopper restricting the unlock lever from rotating in the specific direction to retain the unlock lever at a specific position; wherein when the outside handle rotates to the grip position by the drive force of the first actuator, the switch operation lever integrally rotates with the unlock lever about the first rotary shaft while not coming in contact with the second switch; and when the outside handle rotates from the grip position to the initial position, the unlock lever that rotates in the specific direction by a biasing force of the biasing member comes in contact with the stopper, and the switch operation lever being pressed by the outside handle rotates about the second rotary shaft while pressing the second switch.

4. The outside handle device for the vehicle according to claim 3, further comprising:

a rotary member configured to move the outside handle from the initial position to the grip position by rotating by the drive force of the first actuator when the first switch is caused by the switch operation lever to operate the first actuator, and the rotary member restricting the outside handle from rotating to the initial position by coming in contact with the unlock lever that is operatively connected with the outside handle when the outside handle is disposed at the grip position.

5. The outside handle device for the vehicle according to claim 1, wherein the outside handle includes a vehicle-exterior-side surface;

the vehicle door includes a vehicle-exterior-side surface; and when the outside handle is disposed at the initial position, the vehicle-exterior-side surface of the outside handle is flush with the vehicle-exterior-side surface of the vehicle door.

6. An outside handle device for a vehicle, comprising:

a lock device provided at a vehicle door;

an outside handle rotatably supported at the vehicle door between an initial position and an operation position, the operation position being defined at a vehicle outer position relative to the initial position, the operation position in which the lock device is switched from a latched state to an unlatched state;

a first switch disposed at a portion of the outside handle, the portion disposed inwardly of the vehicle;

a second switch separately provided from the first switch;

a switch operation lever configured to operate the first switch and the second switch; and an actuator configured to be operated by the first switch to generate a first drive force that rotates the outside handle to a grip position that corresponds to a position between the initial position and the operation position, and to be operated by the second switch generate a second drive force that rotates the outside handle from the grip position to the initial position, the actuator generating the first drive force when the switch operation lever rotates in response to rotation of the outside handle inwardly of the vehicle from the initial position and causes the switch operation lever to rotate and cause the first switch to operate the actuator, the actuator generating the second drive force when the second switch is pressed by the switch operation lever; and an unlock lever that is separately provided from the switch operation lever, the outside handle causing the unlock lever to move the lock device to be unlatched when the outside handle rotates to the operation position, and the unlock lever allowing the lock device to be latched when the outside handle rotates inwardly of the vehicle from the initial position.

7. The outside handle device for the vehicle according to claim 6, wherein the unlock lever is rotatably supported at the vehicle door, and the switch operation lever is rotatably supported at the unlock lever.

8. The outside handle device for the vehicle according to claim 7, further comprising:

a first rotary shaft rotatably supporting the unlock lever relative to the vehicle door;

a second rotary shaft being separately provided from the first rotary shaft, the second rotary shaft rotatably supporting the switch operation lever relative to the unlock lever;

a biasing member configured to rotate the unlock lever in a specific direction about the first rotary shaft; and a stopper restricting the unlock lever from rotating in the specific direction to retain the unlock lever at a specific position; wherein when the outside handle rotates to the grip position by the first drive force, the switch operation lever integrally rotates with the unlock lever about the first rotary shaft while not coming in contact with the second switch; and when the outside handle rotates from the grip position to the initial position, the unlock lever that rotates in the specific direction by a biasing force of the biasing member comes in contact with the stopper, and the switch operation lever being pressed by the outside handle rotates about the second rotary shaft while pressing the second switch.

9. The outside handle device for the vehicle according to claim 8, further comprising:

a rotary member configured to move the outside handle from the initial position to the grip position by rotating by the first drive force when the first switch is caused by the switch operation lever to operate the actuator, and the rotary member restricting the outside handle from rotating to the initial position by coming in contact with the unlock lever that is operatively connected with the outside handle when the outside handle is disposed at the grip position.

10. The outside handle device for the vehicle according to claim 6, wherein the outside handle includes a vehicle-exterior-side surface;

the vehicle door includes a vehicle-exterior-side surface; and when the outside handle is disposed at the initial position, the vehicle-exterior-side surface of the outside handle is flush with the vehicle-exterior-side surface of the vehicle door.

11. An outside handle device for a vehicle, comprising:

a lock device provided at a vehicle door;

an outside handle rotatably supported at the vehicle door between an initial position and an operation position, the operation position being defined at a vehicle outer position relative to the initial position, the operation position in which the lock device is switched from a latched state to an unlatched state;

a switch disposed at a portion of the outside handle, the portion disposed inwardly of the vehicle;

a switch operation lever configured to operate the switch;

a first actuator configured to be operated by the switch to generate a drive force that rotates the outside handle to a grip position that corresponds to a position between the initial position and the operation position when the switch operation lever rotates in response to rotation of the outside handle inwardly of the vehicle from the initial position and causes the switch operation lever to rotate and cause the switch to operate the first actuator; and an unlock lever that is separately provided from the switch operation lever, the outside handle causing the unlock lever to move the lock device to be unlatched when the outside handle rotates to the operation position, and the unlock lever allowing the lock device to be latched when the outside handle rotates inwardly of the vehicle from the initial position.

* * * * *